US006716064B2

(12) United States Patent
Kubo

(10) Patent No.: US 6,716,064 B2
(45) Date of Patent: Apr. 6, 2004

(54) SHIELDED CONNECTOR ASSEMBLY AND SHIELDED CONNECTOR

(75) Inventor: Takafumi Kubo, Tokyo (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/325,368

(22) Filed: Dec. 19, 2002

(65) Prior Publication Data

US 2003/0119347 A1 Jun. 26, 2003

(30) Foreign Application Priority Data

Dec. 21, 2001 (JP) ..... 2001-389849

(51) Int. Cl.[7] ..... H01R 13/648

(52) U.S. Cl. ..... 439/607; 439/541.5; 439/676; 439/701; 439/610

(58) Field of Search ..... 439/607, 610, 439/676, 108, 488, 489, 636, 637, 541.5, 609, 701, 540.1

(56) References Cited

U.S. PATENT DOCUMENTS 5,505,637 A * 4/1996 Kramer et al.
5,812,660 A 9/1998 Suzuki et al. ..... 379/438
5,842,885 A * 12/1998 Takamoto et al.
6,056,600 A * 5/2000 Watanabe et al.
6,231,390 B1 * 5/2001 Chang
6,280,208 B1 * 8/2001 Masuda et al.

* cited by examiner

*Primary Examiner*—Anthony Dinkins
*Assistant Examiner*—Nguyen T. Ha
(74) *Attorney, Agent, or Firm*—Barley, Snyder, Senft & Cohen, LLC

(57) ABSTRACT

A shielded connector assembly having an electrical connector and a recharging connector portion. The electrical connector having a first insulating housing with contacts disposed therein, a first fixing portion, and a shielding shell disposed about the first insulating housing. The recharging connector portion including a second insulating housing having a terminal, and a second fixing portion that engages the first fixing portion to detachably mount the recharging connector portion to the housing.

18 Claims, 6 Drawing Sheets

SHIELDED CONNECTOR ASSEMBLY AND SHIELDED CONNECTOR

BACKGROUND OF THE INVENTION

The invention relates to electrical connectors and, more particularly, to a shielded connector assembly having a recharging connector portion.

DESCRIPTION OF THE PRIOR ART

Various types of electrical connectors, such as cellular telephones, are provided with a metallic shielding shell to protect signal paths of the connector from external electromagnetic waves. The shielding shell is formed to cover an outer periphery of an insulating housing having electrical contacts therein. The shielding shell may be formed by punching and bending a metal plate into a standarized dimension and shape, such as a cube or a cylinder.

Shielded connectors used for cellular telephones are commonly referred to as a "combined type." The combined type shielded connector is provided with a recharging connector portion to add a recharging function thereto. An example of a combined type shielded connector assembly is disclosed in U.S. Pat. No. 5,812,660 titled "Portable Phone Composite Connector." The portable phone composite connector has an input/output (I/O) connector portion and a recharging connector portion with recharging terminals provided within a single shielded connector assembly.

The configuration of the recharging terminals, such as the interval therebetween, varies from one manufacturer of cellular telephones to another. Because the connector portion and the recharging connector portion are integrally formed, when the recharging connector portion is configured differently, the entire shielded connector assembly must be rebuilt. In addition, because the recharging connector portion is not securely fixed, repeated use of the recharging connector portion often results in positional misalignment.

It is therefore desirable to provide a shielded connector assembly wherein the recharging connector portion is fixed onto a circuit board to withstand positional misalignment from repeated usage. It is further desirable to provide a shielded connector assembly wherein various configurations of recharging terminals are easily accommodated by simply changing the recharging connector portion.

SUMMARY OF THE INVENTION

The invention relates to a shielded connector assembly having an electrical connector and a recharging connector portion. The electrical connector having a first insulating housing with contacts disposed therein, a first fixing portion, and a shielding shell disposed about the first insulating housing. The recharging connector portion including a second insulating housing having a terminal, and a second fixing portion that engages the first fixing portion to detachably mount the recharging connector portion to the housing.

DETAILED DESCRIPTION OF THE PREFERRED EMBODIMENT

Figure 1:
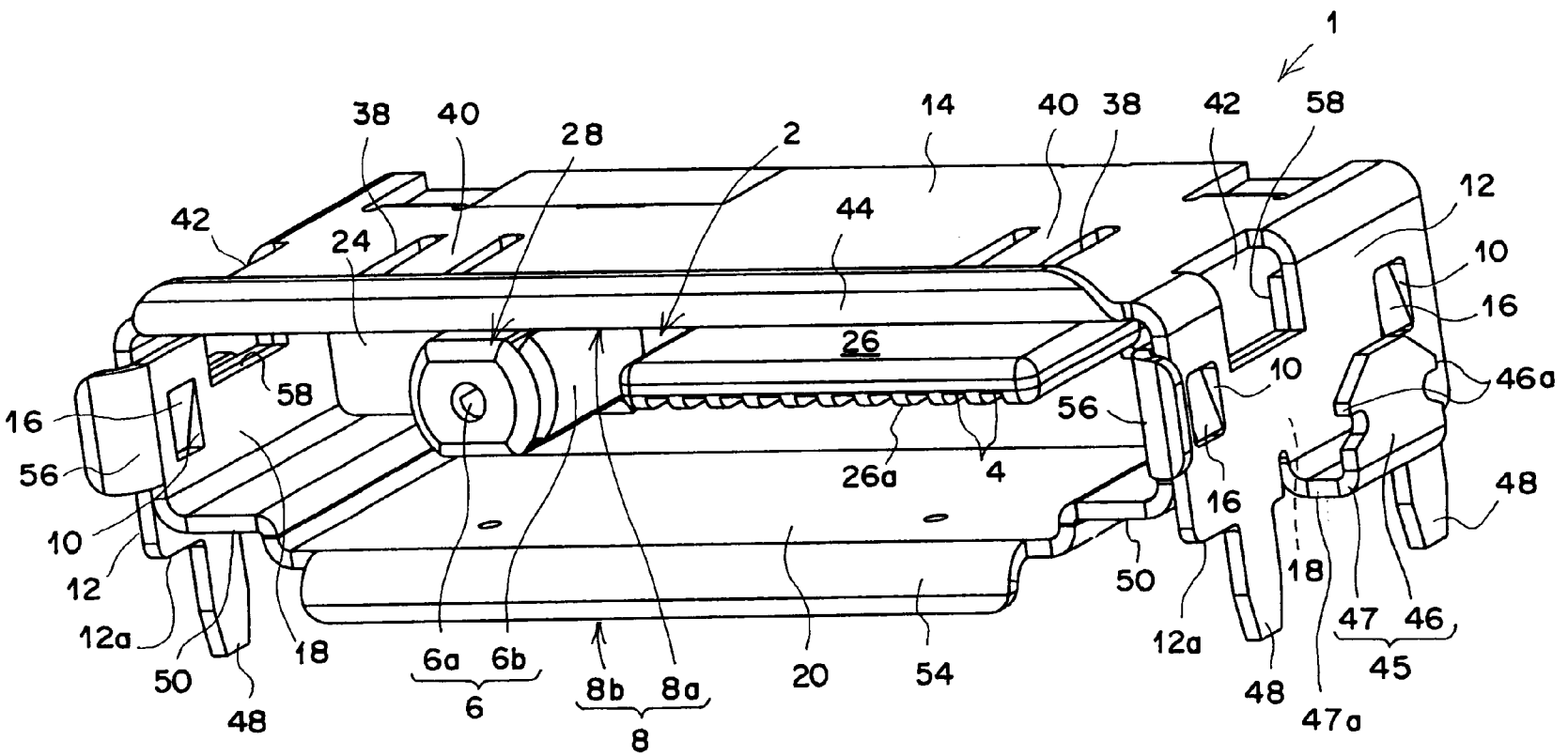
FIG. 1 is a perspective view of a shielded connector of the present invention viewed from a side of an engagement opening.
Figure 2:
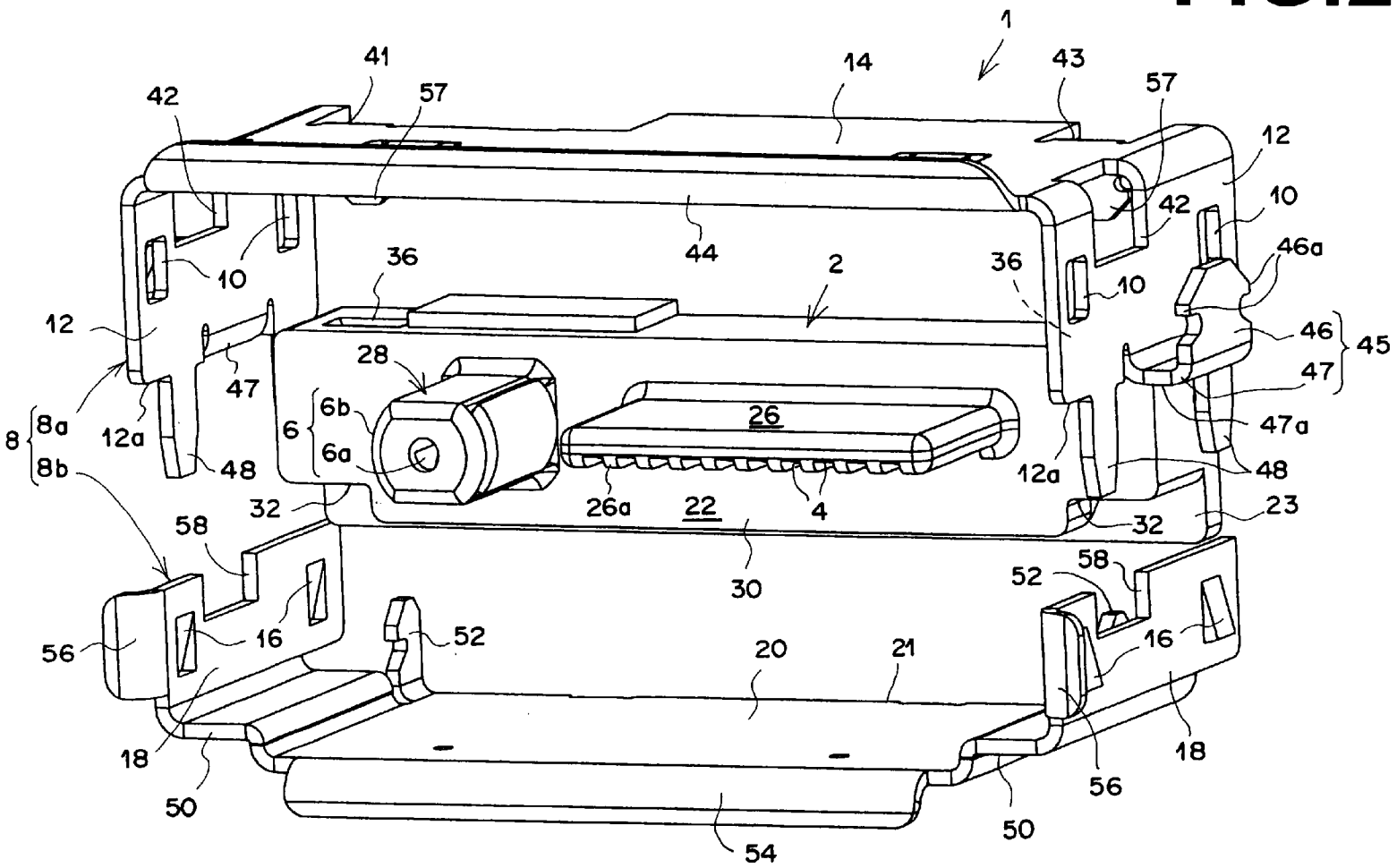
FIG. 2 is an exploded perspective view of the connector of FIG. 1.

The present invention relates to a shielded connector assembly 100 having a shielded connector 1 and a recharging connector portion 102. FIGS. 1–2 show the shielded connector 1 having an insulating housing 2 covered by a shielding shell 8. As shown most clearly in FIG. 2, the housing 2 has a horizontal engagement rib 26 and a cylindrical protrusion 28. A plurality of contacts 4 are arranged on the engagement rib 26 and are separated from each other by a plurality of walls 26*a*. The cylindrical protrusion 28 houses a coaxial contact 6. The coaxial contact 6 has a central contact 6*a* and an arcuate outer contact 6*b*. Steps 32 are formed on both sides of a bottom 30 of the housing 2. A plate 23 that abuts a rear edge 21 of a lower shell 8*b* is formed on the bottom 30 of the housing 2 and extends in a lengthwise direction thereof (the horizontal direction in FIG. 2). Holes 36 are formed at both sides of an upper portion of the housing 2.

A top guide piece 44 is formed at a forward edge of the upper wall 14 and extends from one side wall 12 to the other side wall 12. The top guide piece 44 guides a mating connector (not shown) into engagement opening 24. As shown in FIGS. 1 and 2, rectangular openings 42 are formed in the upper wall 14 and the side walls 12, 12. The rectangular openings 42 engage locking arms (not shown) of the mating connector (not shown). The locking arms (not shown) of the mating connector (not shown) engage with the openings 42 to lock the connectors to each other.

As shown most clearly in FIG. 1, tongue pieces 40 formed from U-shaped slits 38 are positioned in the vicinity of both edges of the upper wall 14. The tongue pieces 40 extend forward (the direction toward the engagement opening 24 or the foreground in FIGS. 1 and 2) and downward. The tongue pieces 40 act as contact pieces for electrical grounding and contact a shielding shell (not shown) of the mating connector (not shown) that is received in the engagement opening 24. Although the tongue pieces 40 are described as extending forward in this embodiment, the tongue pieces may alternatively be formed to extend backward.

Each of the side walls 12 has an engagement protrusion 46. The engagement protrusion 46 is integrally formed with the upper shell 8*a* and has a tapered shape. Barbs 46*a* are formed on both sides of the engagement protrusion 46. The engagement protrusion 46 extends upward from a fold back portion 47 and a horizontal portion 47*a* that extends horizontally from an approximate center of a lower edge 12*a* of each of the side walls 12. The fold back portion 47 and the horizontal portion 47*a* are integrally formed with the upper shell 8*a*. Because the fold back portions 47, the horizontal portions 47*a*, and the engagement protrusions 46 are integrally formed, conservation of space may be achieved. The vertical position of the fold back portion 47 is such that the fold back portion 47 is surface mountable to a circuit board (not shown) when the shielded connector 1 is mounted thereon. The fold back portion 47 and the engagement protrusion 46 are collectively referred to as fixing portions 45.

A pair of downwardly extending legs or tines 48 is integrally formed at the lower edges 12*a* of each of the side walls 12. The tines 48 are received in apertures (not shown) of the circuit board (not shown) and soldered thereto when the shielded connector 1 is mounted on the circuit board (not shown). Although the tines 48 are described as extending downward, the tines 48 may alternatively be formed to extend outward so as to enable surface mounting similar to the fold back portions 47.

The lower shell 8*b* has a lower wall 20 that has upwardly extending side walls 18. Engagement pieces 52 protrude from both sides of a rear portion of the lower wall 20. The engagement pieces 52 are press-fit into holes (not shown) formed in the bottom 30 of the housing 2 and are engaged thereto when the shielding shell 8 and the housing 2 are assembled. A pair of latch arms or second locking members 16 is formed on each of the side walls 18 of the lower shell 8*b*. The latch arms 16 incline outwardly and correspond with the engagement apertures 10 to be fixed at upper ends thereof. The distance between the side walls 18 is shorter than the distance between the side walls 12 of the upper shell 8*a* so that the side walls 18 of the lower shell 8*b* are disposed inside the side walls 12 of the upper shell 8*a* when the upper shell 8*a* and lower shell 8*b* are assembled.

A bottom guide piece 54 is formed at a forward edge of the lower wall 20 and extends from one side wall 18 to the other side wall 18. Side guide pieces 56 are formed on each of the side walls 18. The bottom and side guide pieces 54, 56 guide the mating connector (not shown) into the engagement opening 24.

The side walls 18 have cut-outs 58 corresponding to the openings 42 of the upper shell 8*a*. Steps 50 are formed between the lower wall 20 and the side walls 18. The steps 50 surround the housing 2 along the step 32 of the housing 2 when the shielding shell 8 and the housing 2 are assembled.

When the shielded connector 1 is assembled, the engagement pieces 57 of the upper shell 8*a* are press-fit into the holes 36 of the housing 2 to fix the upper shell to the housing 2. The engagement pieces 52 of the lower shell 8*b* are press-fit into the holes (not shown) on the bottom 30 of the housing 2 to fix the lower shell 8*b* to the housing 2. The side walls 18 of the lower shell 8*b* are disposed inside the side walls 12 of the upper shell 8*a* so that the side walls 12 and the side walls 18 overlap. The latch arms 16 engage with the engagement apertures 10 to fix the upper shell 8*a* and the lower shell 8*b* to each other.

Deformation in the vertical direction is prevented when a prying force is applied in the vertical direction due to the construction described above, wherein the upper shell 8*a* and lower shell 8*b* are held so not to separate in the vertical direction. When a prying force is applied in the horizontal direction, the side walls 12 of the upper shell 8*a* prevent the opening of the lower shell 8*b* so that deformation is prevented. In addition, because the upper shell 8*a* is fixed to a circuit board by soldering the tines 48 thereto, vertical as well as horizontal movement of the upper shell 8*a* becomes difficult. This fixing further increases the effect of preventing deformation, and the shield shell 8 is structured to resist deformation due to prying forces and external forces in any direction.

Figure 3:
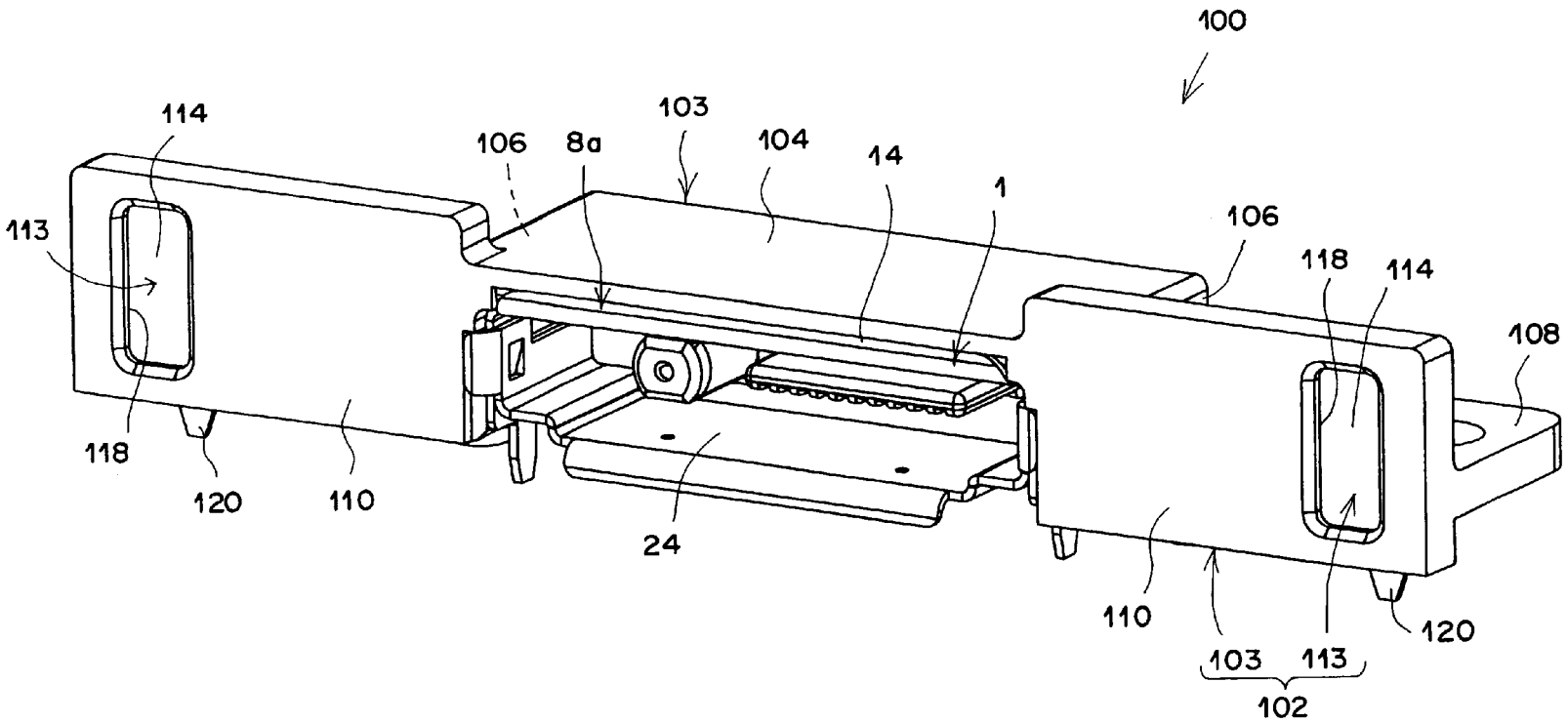
FIG. 3 is a perspective view of the shielded connector assembly of the present invention from the side of the engagement opening.

The recharging connector portion 102 will now be described in greater detail with reference to FIGS. 3 through 5. The recharging connector portion 102 has an insulative housing 103. The housing 103 has an upper wall 104 that covers the upper wall 14 of the upper shell 8*a*, outer walls 106 that extend downward from both edges of the upper wall 104 to cover the side walls 12 of the upper shell 8*a*, and flanges 108 that extend horizontally outward from lower edges of the outer walls 106. Front walls 110 extend in the same plane as the engagement opening 24 to the sides thereof and are integrally formed with the outer walls 106 and the flanges 108.

Electrodes or terminals 113 are provided on outer edges of the front walls 110. The terminals 113 have conductive pads 114 for contacting contact elements (not shown) of a recharging device (not shown) and for providing current to a battery (not shown). The conductive pads 114 are press-fit into grooves 116, shown in FIG. 4, that extend from lower surfaces to upper regions of the front walls 110. Substantially rectangular openings 118 communicate with the grooves 116 and are open toward a front side to enable access to the conductive pads 114, which are press fit into the grooves 116 through the openings 118. In the alternative, the grooves 116 may be formed to open to the upper surface of the front walls 110, and the terminals may be inserted therein from above. Barbs for engaging the grooves 116 may be formed on side edges of the conductive pads 114 press-fit therein. Because the conductive pads 114 are exposed to an exterior, when a cellular phone is placed on the recharging device (not shown), electrical contact pieces thereof contact the conductive pads 114 to enable recharging.

Tines 120 are formed on the lower edges of the conductive pads 114. The tines 120 extend along the lower surfaces of the flanges 108 and are bent downward. The tines 120 are directly electrically connected to conductive paths (not shown) of the circuit board by soldering to form a circuit independent of the shielded connector 1.

Receiving holes or second fixing portions 124 having receiving openings 122 are formed on the lower surfaces of the outer walls 106 and extend upward to within the outer walls 106. The receiving holes 124 correspond to the engagement protrusions 46, shown in FIGS. 1 and 2, and are dimensioned so that the engagement protrusions 46 may be press-fit therein. The barbs 46*a* of the engagement protrusions 46 engage with inner walls of the receiving holes 124 to fix the engagement protrusions 46 therein. Although the second fixing portions 124 are formed as holes 124, the second fixing portions 124 may also be formed as grooves having receiving openings, or dovetail grooves. Because the engagement protrusions 46 extend upward and the corresponding holes 124 are also formed upward, press-fitting is thereby facilitated.

Figure 4:
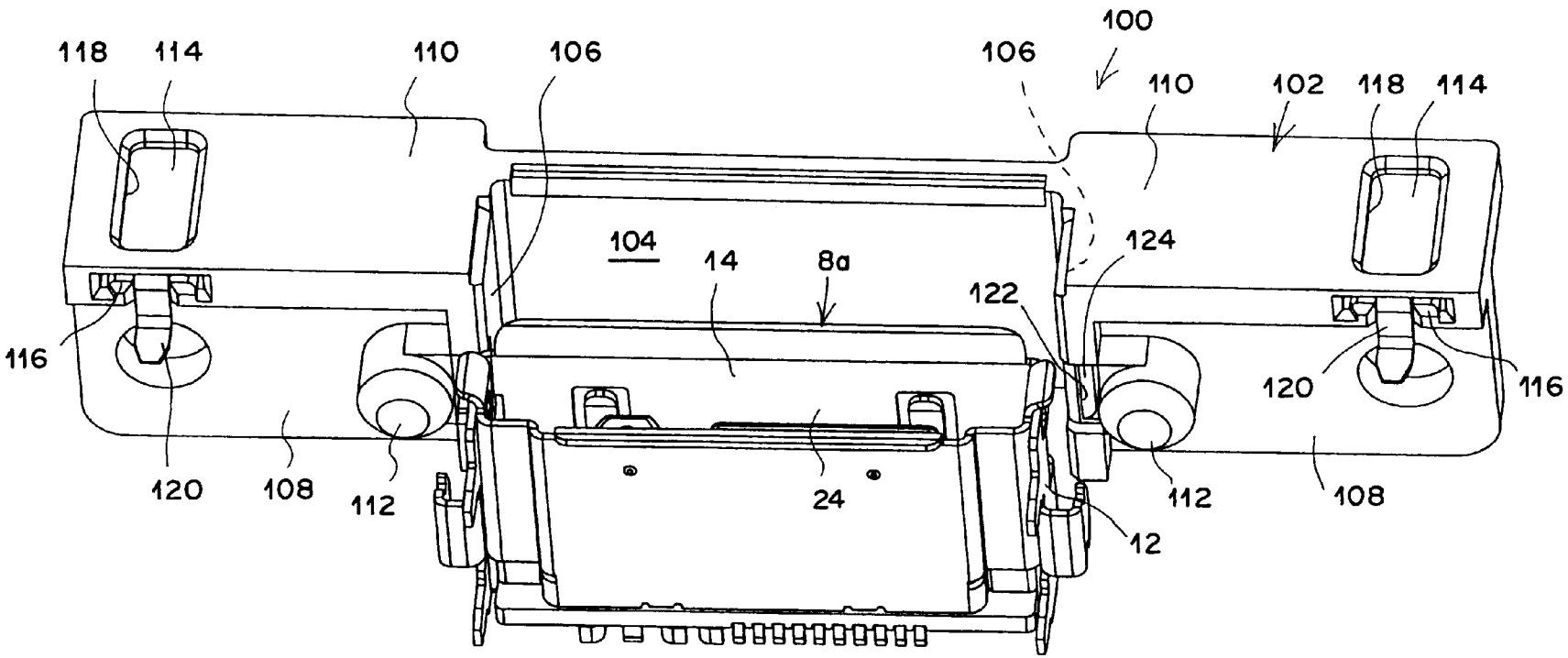
FIG. 4 is a perspective view of the shielded connector assembly of FIG. 3 divided into the shielded connector and the recharging connector portion from below the side of the engagement opening.
Figure 5:
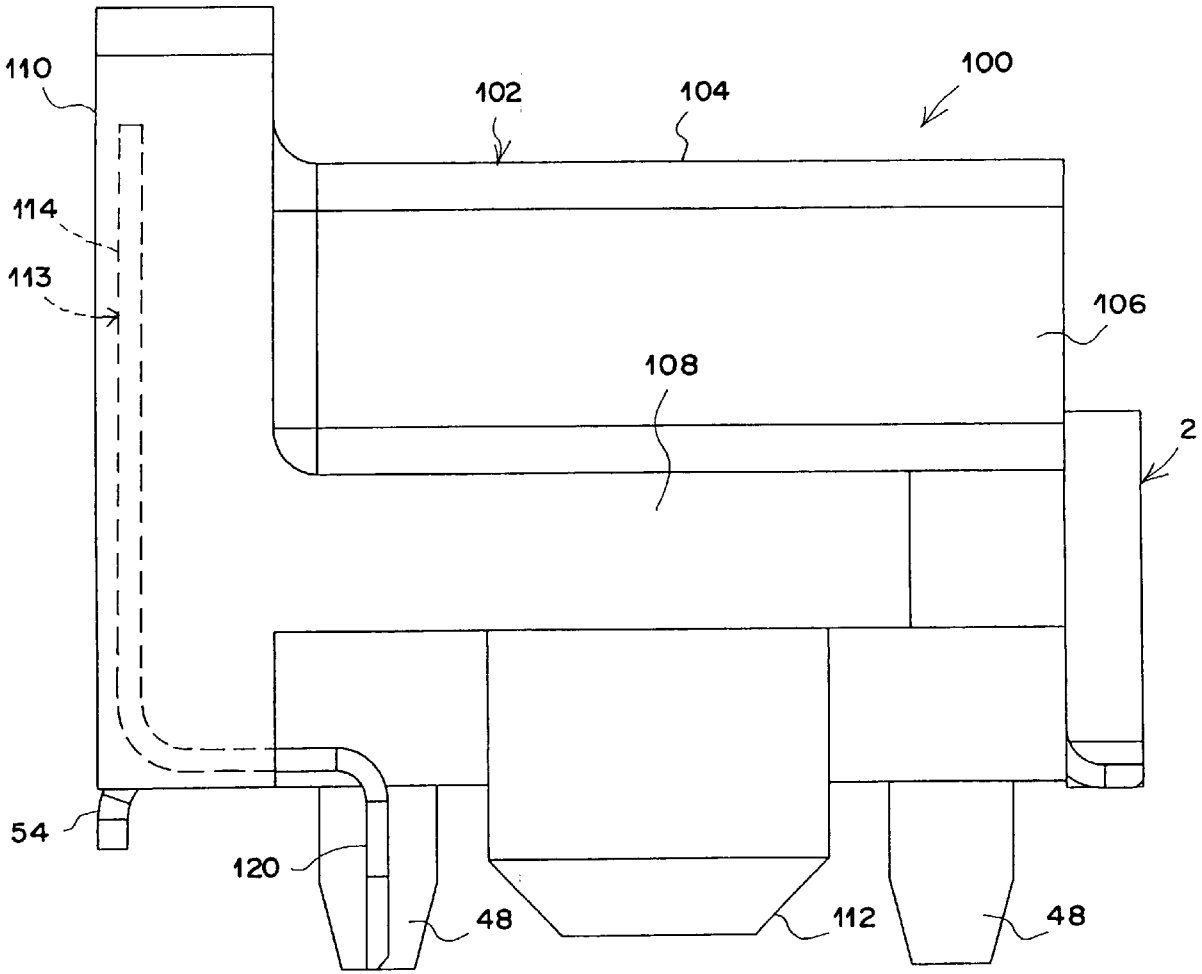
FIG. 5 is a plan side view of the shielded connector assembly of FIG. 3.

As shown in FIGS. 4 and 5, columnar bosses 112 are formed on lower surfaces of each of the flanges 108. The bosses 112 are inserted into openings of the circuit board (not shown) when the shielded connector assembly 100 is mounted thereto to position the recharging connector portion 102.

Figure 6:
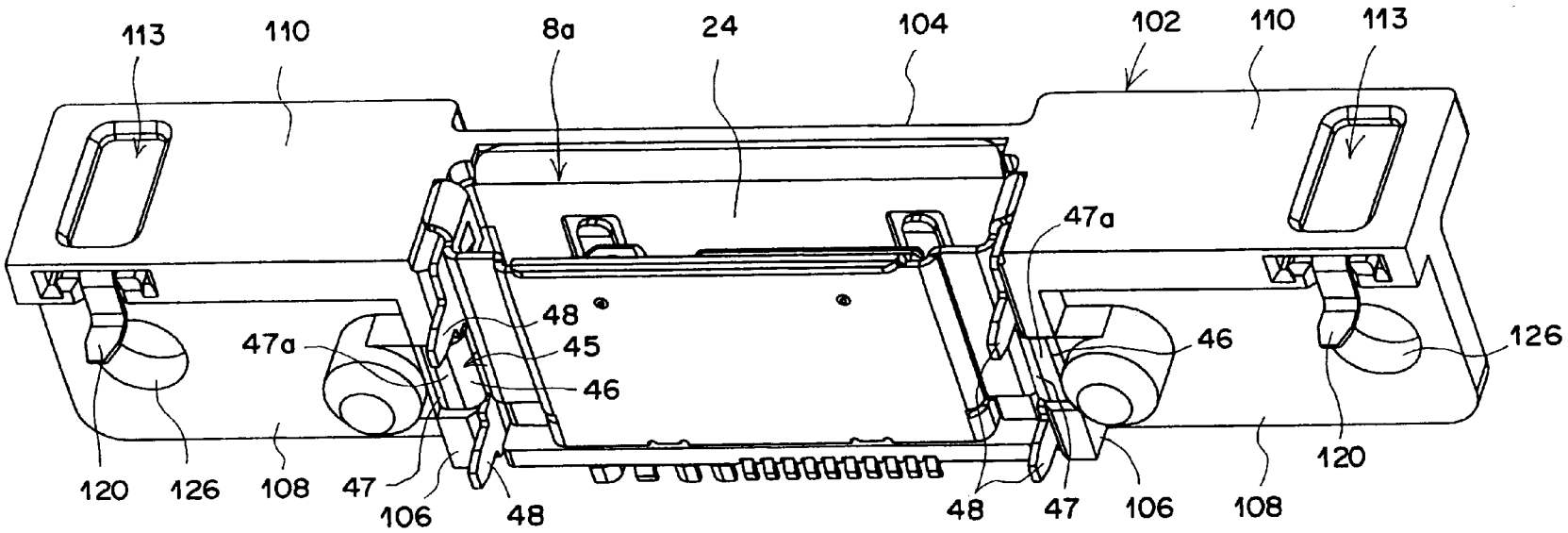
FIG. 6 is a perspective view of the shielded connector assembly from below the side of the engagement opening.

The assembly of the recharging connector portion 102 to the shielded connector 1 will now be described with reference to FIG. 6. The recharging connector portion 102 is mounted on the shielded connector 1 by positioning the upper wall 104 of the recharging connector portion 102 adjacent to the upper wall 14 of the upper shell 8*a* so that the lower surfaces of the outer walls 106 and the front walls 110 are in substantially the same plane as the lower surface of the lower shell 8*b*. The engagement protrusions 46 are press-fit in the receiving holes 124. The tines 48 of the upper shell 8*a* and the tines 120 of the recharging terminals 113 are inserted through apertures of the circuit board (not shown) and fixed by soldering thereto. Thus, the shielded connector assembly

100 is mounted in a stable condition on the circuit board (not shown), and the recharging connector portion 102 is securely mounted to the shielded connector 1. For additional stability, the horizontal portions 47*a* of the engagement protrusions 46 may be surface mounted to the circuit board (not shown) by soldering. The horizontal portion 47*a* increases the soldering area, therefore, enhanced soldering strength may be obtained. Screws (not shown) may also be inserted through apertures 126 in the flanges 108 and attached to the circuit board (not shown).

Because the engagement protrusions 46 are press-fit in the receiving holes 124, the recharging connector portion 102 may be solidly fixed from an exterior of the shielded connector 1 without positional misalignment. Additionally, if the separate recharging connector portion 102 is exchanged, only the recharging connector portion 102 needs to be replaced. In this manner, recharging terminals of different configurations may be easily accommodated.

The foregoing illustrates some of the possibilities for practicing the invention. Many other embodiments are possible within the scope and spirit of the invention. For example, the fold back portions 47 may be of a U-shape, without the horizontal portions 47*a*. In addition, the engagement protrusions 46 need not extend upward, but may alternatively extend forward or backward. In this case, the receiving holes 124 of the recharging connector portion 102 may be formed to extend forward or backward, corresponding to the engagement protrusions 46. It is, therefore, intended that the foregoing description be regarded as illustrative rather than limiting, and that the scope of the invention is given by the appended claims together with their full range of equivalents.

I/we claim:

1. A shielded connector assembly comprising:

an electrical connector having a first insulating housing with contacts disposed therein, a first fixing portion, and a shielding shell disposed about the first insulating housing; and a recharging connector portion including a second insulating housing having a terminal, and a second fixing portion that engages the first fixing portion to mount the recharging connector portion to the housing;

wherein the electrical connector and the recharging connector portion form a single assembly to add a recharging function to the electrical connector.

2. The shielded connector assembly of claim 1, wherein the first fixing portion extends from a surface of the shielding shell and is press-fit into the second fixing portion.

3. The shielded connector assembly of claim 2, wherein the first fixing portion includes barbs for engaging the second fixing portion.

4. The shielded connector assembly of claim 2, wherein the first fixing portion is surface mounted to a circuit board.

5. The shielded connector assembly of claim 1, wherein the terminal has a conductive pad and the terminal is press-fit into the second insulating housing so that the conductive pad is exposed to an exterior thereof.

6. The shielded connector assembly of claim 5, wherein the terminals include barbs for engaging the second insulating housing.

7. The shielded connector assembly of claim 1, further comprising a boss that extends from the second insulating housing to mount the recharging connector portion to a circuit board.

8. The shielded connector assembly of claim 1, wherein the second insulating housing has an aperture for receiving a screw to mount the recharging connector portion to a circuit board.

9. The shielded connector assembly of claim 1, further comprising a tine that extends from the terminal to engage a circuit board.

10. The shielded connector assembly of claim 1, wherein the first fixing portion is integrally formed with the shielding shell.

11. The shielded connector assembly of claim 10, wherein the first fixing portion is essentially U-shaped.

12. A recharging connector portion for a shielded connector, comprising:

an insulating housing for disposing about the shielded connector, the insulating housing having a terminal and a fixing portion for engaging the shielded connector and detachably mounting the recharging connector portion thereto.

13. The recharging connector portion of claim 12, wherein the fixing portion is an opening for receiving an engagement portion disposed on the shielded connector, the opening extends from a bottom surface of the insulating housing up into the insulating housing.

14. The recharging connector portion of claim 12, wherein the terminal has a conductive pad and the terminal is press-fit into the insulating housing so that the conductive pad is exposed to an exterior thereof.

15. The recharging connector portion of claim 14, wherein the terminals include barbs for engaging the insulating housing.

16. The recharging connector portion of claim 12, further comprising a boss that extends from the insulating housing to mount the recharging connector portion to a circuit board.

17. The recharging connector portion of claim 12, wherein the insulating housing has an aperture for receiving a screw to mount the recharging connector portion to a circuit board.

18. The recharging connector portion of claim 12, further comprising a tine that extends from the terminal to engage a circuit board.

* * * * *